US006386455B1

(12) United States Patent
Wynter

(10) Patent No.: US 6,386,455 B1
(45) Date of Patent: May 14, 2002

(54) BADGE ARRANGEMENT AND BADGE WITH VISUAL OR AUDIO INDICATOR

(76) Inventor: Junior George Wynter, 58 Aboyne Road, London (GB), NW10 OHA ( * ) Notice: Subject to any disclaimer, the term of this patent is extended or adjusted under 35 U.S.C. 154(b) by 0 days.

(21) Appl. No.: 09/531,557

(22) Filed: Mar. 20, 2000

(51) Int. Cl.[7] ..... G06K 7/00
(52) U.S. Cl. ..... 235/486; 362/103; 362/394
(58) Field of Search ..... 235/486; 362/103, 362/104, 233

(56) References Cited

U.S. PATENT DOCUMENTS 4,965,705 A * 10/1990 Lin ..... 362/103
5,383,044 A * 1/1995 Borchardt et al. ..... 340/825.72
5,567,037 A 10/1996 Ferber ..... 362/104
6,290,269 B1 * 9/2001 Bodley-Scott et al. ..... 292/216

FOREIGN PATENT DOCUMENTS

GB 2269798 A * 2/1994

* cited by examiner

*Primary Examiner*—Karl D. Frech
*Assistant Examiner*—Lisa M. Caputo
(74) *Attorney, Agent, or Firm*—Jacobson Holman, PLLC

(57) ABSTRACT

A badge arrangement comprises a badge (1) having an electrically actuated visual or audio indicator (7) and arranged to be worn by a user and a controller (2) remote from the badge (eg in the user's pocket) and operable by a user to actuate the indicator. The arrangement is intended to be used at a singles gathering, during which the wearer of the badge would operate his/her transmitter when facing a person with whom he/she wished to arrange a date and that person would then operate her/his transmitter in response if he/she were receptive to this idea.

20 Claims, 1 Drawing Sheet

BADGE ARRANGEMENT AND BADGE WITH VISUAL OR AUDIO INDICATOR

Figure 1:
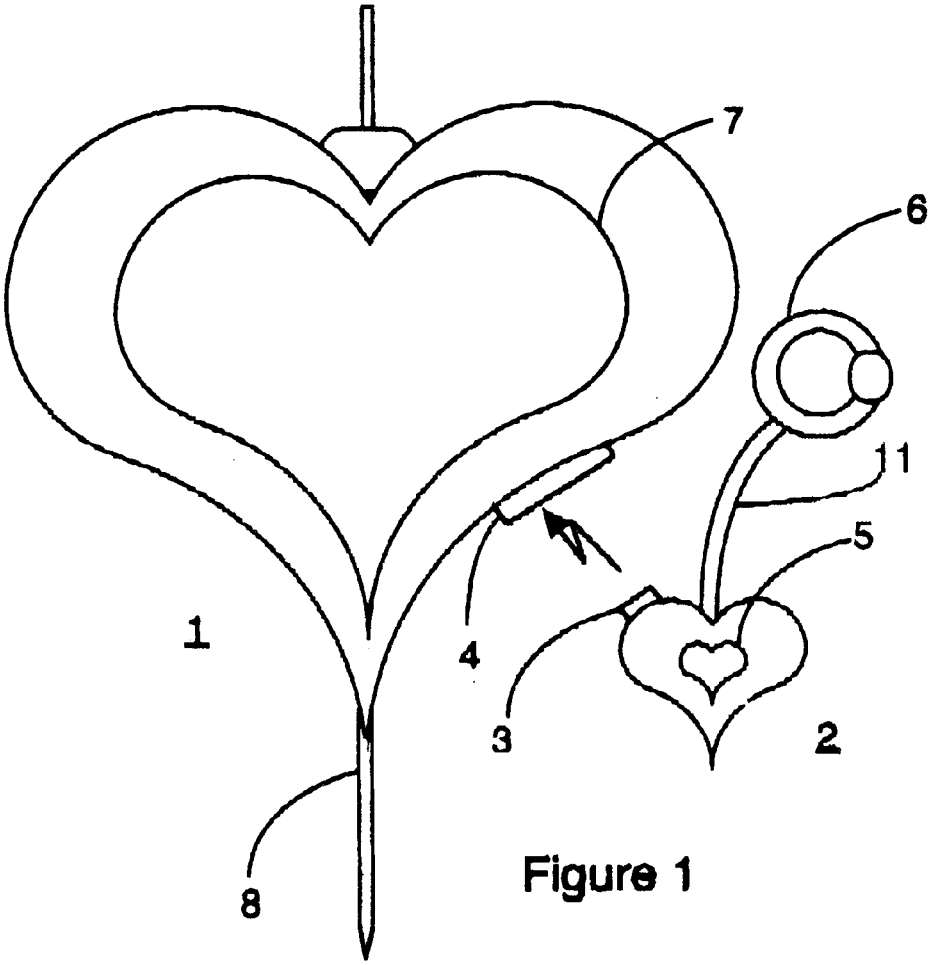

The present invention relates to a badge and a badge arrangement wherein the badge has an electrically actuated visual or audio indicator.

Badges are known which comprise an LED (light-emitting diode) powered by a miniature cell in the badge casing in order to increase the visual impact of the badge. In order to conserve power, such badges include an integral ON/OFF switch at the rear of the casing. Consequently the LED cannot easily be turned on and off whilst the badge is being worn. This is normally of no consequence.

However a need has now been identified for a badge and a badge arrangement with an electrically actuated visual or audio indicator which can be operated in a discreet manner whilst the badge is being worn.

This need arises at parties and other social gatherings organised for single people, eg by dating agencies, where considerable emotional stress can be caused by the risk of rejection by a person of the opposite sex. It is frequently embarassing to strike up a conversation with a stranger at such a gathering and if that person is uninterested but tactful then considerable time can be wasted before discovering that there is no point in pursuing a relationship with that person. It would be advantageous to know his or her attitude towards oneself at the outset and it would also be advantageous to be able to signal one's interest in a clearcut but socially acceptable manner.

Accordingly in one aspect the invention provides a badge arrangement comprising a badge having an electrically actuated visual or audio indicator and arranged to be worn by a user and a controller remote from the badge and operable by a user to actuate the indicator.

The controller will normally be used by the wearer of the badge to control the indicator on his/her own badge but in a variant could be used to control the indicator on the badge of a person of interest in order to grab that person's attention.

Preferably the controller comprises a miniature radio transmitter and the badge comprises a miniature radio receiver coupled to the indicator and responsive to a radio signal transmitted by the radio transmitter. The radio transmitter can for example be similar to those used in miniature remote controllers for operating and releasing vehicle locking systems and is conveniently carried and operated in the user's pocket.

At a singles gathering, the wearer of the badge would operate his/her transmitter when facing a person with whom he/she wished to arrange a date and that person would then operate her/his transmitter in response if he/she were receptive to this idea.

In the most basic embodiment the indicator has one OFF state and one ON state. However in another embodiment the indicator has one OFF state and two ON states. One of these ON states can be used to signal acceptance and the other to signal rejection.

It is anticipated that the indicator (eg an LED) and/or the badge itself could be in the form of a romantic symbol eg a heart or a cherub and that the arrangement would be a talking point which would help to "break the ice" and lighten the atmosphere at a party or social gathering.

In another aspect of the invention provides a badge having an electrically actuated visual or audio indicator and arranged to be worn by a user, the badge having a receiver responsive to radio, ultrasonic or infra-red signals and arranged to operate the indicator in response to such signals.

Such a badge could be used at social gatherings for singles as described above and could be used more generally in games and as a novelty.

Preferred features of the invention are defined in the dependent claims.

Figure 2:
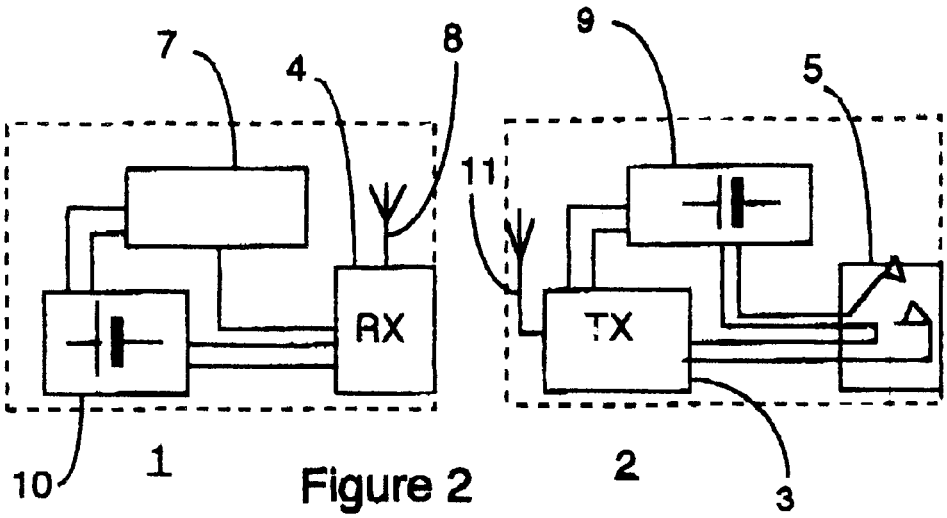

An embodiment of the invention is described below by way of example onely with reference to FIGS. 1 and 2 of the accompanying drawing, wherein:

FIG. 1 is a front elevation of a badge and transmitter arrangement in accordance with the invention, and FIG. 2 is a schematic block diagram of one circuit arrangement which can be used in the badge and transmitter arrangement of FIG. 1.

Referring to FIG. 1, the badge 1 is generally heart-shaped and carries a prominent heart-shaped display 7 illuminated by an LED (not shown). The badge carries a pin 8 or other means for securing the badge to the wearer's clothing, eg to a lapel. A receiver 4 is responsive to signals from a transmitter 3 of a controller 2 (preferably radio signals but in other embodiments ultrasonic or even possibly even infra-red signals could be used). The controller is operated by a push-button 5 and is linked to a key-ring 6 by a metal link 11.

Referring to FIG. 2, the badge is provided in this embodiment with a miniature UHF radio receiver 4 whose antenna input is coupled to pin 8 (so that the latter acts as at least a part of the receiver's antenna) and which has an two-state output to indicator 7. When this output is HIGH the indicator 7 flashes on and off, under the control of conventional flasher circuitry (not shown). When the output is LOW the indicator is off (not lit up). Receiver 4 and indicator 7 are both energised by a suitable cell or battery 10 which is contained in the badge casing.

The controller 2 comprises a UHF transmitter (3) energised by a cell or battery 9 under the control of a click action push-button switch 5. The RF output of the transmitter (3) is coupled to the metal link 11 (or alternatively to the key ring 6, the link 11 being omitted) so that the link and/or key ring function as at least part of the transmitting antenna.

In another embodiment (not shown) the indicator 7 could be energised via an electric lead, concealed in the wearer's clothing and connected between the badge 1 and controller 2, enabling the radio circuitry to be dispensed with.

I claim:

1. A badge in combination with a remote controller, the badge having an electrically actuated indicator selected from the group consisting of visual and audio indicators and the remote controller being operable from a user's pocket to actuate the indicator.

2. A combination as claimed in claim 1 wherein said remote controller comprises a miniature radio temperature for transmitting a radio signal and said badge comprises a miniature radio receiver for actuating said electrically actuated indicator in response to said radio signal.

3. A combination as claimed in claim 2 wherein the radio signal is a UHF signal.

4. A combination as claimed in claim 3 wherein said miniature radio transmitter is provided with an antenna comprising a key ring and a conductive link is provided for coupling the key ring to the radio transmitter.

5. A combination as claimed in claim 3 wherein said miniature radio receiver has a receiving antenna comprising a pin for securing said badge to a wearer's clothing.

6. A combination as claimed in claim 2 wherein said miniature radio transmitter is provided with an antenna comprising a key ring and a conductive link is provided for coupling the key ring to the radio transmitter.

7. A combination as claimed in claim 6 wherein said miniature radio receiver has a receiving antenna comprising a pin for securing said badge to a wearer's clothing.

8. A combination as claimed in claim 2 wherein said miniature radio receiver has a receiving antenna comprising a pin for securing said badge to a wearer's clothing.

9. A combination as claimed in claim 2 wherein said electrically actuated indicator has one OFF state and one ON state.

10. A combination as claimed in claim 2 wherein said electrically actuated indicator has one OFF state and two ON states.

11. A combination as claimed in claim 2 wherein said electrically actuated indicator comprises an LED.

12. A combination as claimed in claim 2 wherein said badge is in the form of a romantic symbol.

13. A combination as claimed in claim 2 wherein said electrically actuated indicator is in the form of a romantic symbol.

14. A combination as claimed in claim 2 wherein said remote controller is provided with tuning means for selectively actuating said user's badge.

15. A combination as claimed in claim 1 wherein said electrically actuated indicator has one OFF state and one ON state.

16. A combination as claimed in claim 1 wherein said electrically actuated indicator has one OFF state and two ON states.

17. A combination as claimed in claim 1 wherein said electrically actuated indicator comprises an LED.

18. A combination as claimed in claim 1 wherein said badge is in the form of a romantic symbol.

19. A combination as claimed in claim 1 wherein said electrically actuated indicator is in the form of a romantic symbol.

20. A combination as claimed in claim 1 wherein said remote controller is provided with tuning means for selectively actuating said user's badge.

* * * * *